United States Patent [19]

Illien

[11] Patent Number: 5,069,186

[45] Date of Patent: Dec. 3, 1991

[54] FUEL INJECTION ASSEMBLY FOR INTERNAL COMBUSTION ENGINE

[76] Inventor: Mario Illien, Quarry Road, Brixworth, Northamptonshire, England, NN6 9EN

[21] Appl. No.: 465,742

[22] Filed: Jan. 17, 1990

[30] Foreign Application Priority Data

Jan. 19, 1989 [GB] United Kingdom ..... 8901132

[51] Int. Cl.[5] ..... F02M 55/02

[52] U.S. Cl. ..... 123/470; 123/456; 251/129.09; 239/413; 137/606

[58] Field of Search ..... 123/456, 472, 470, 575, 123/576, 577-578, 299-300; 137/606; 239/585, 412, 413; 251/129.09

[56] References Cited

U.S. PATENT DOCUMENTS

| | | | |
|---|---|---|---|
| 2,146,930 | 2/1939 | Bassett | 251/129.09 |
| 3,167,091 | 1/1965 | Holdren | 137/606 |
| 3,592,573 | 7/1971 | Tikijian | 239/413 |
| 3,749,097 | 7/1973 | Grow | 123/575 |
| 4,235,205 | 11/1980 | Fukui | 123/472 |
| 4,499,861 | 2/1985 | Wiegand | 123/576 |
| 4,554,903 | 11/1985 | Straubel | 123/575 |
| 4,556,037 | 12/1985 | Wisdom | 123/472 |
| 4,856,713 | 8/1989 | Burnett | 239/585 R |
| 4,955,347 | 9/1990 | Toyoda | 123/472 |

*Primary Examiner*—Carl Stuart Miller

*Attorney, Agent, or Firm*—Lee, Mann, Smith, McWilliams & Sweeney

[57] ABSTRACT

A fuel injection assembly for an internal combustion engine comprises a pair of solenoid valves mounted on a common manifold defining a fuel supply passage which is filled with pressurized fuel at all times during operation of the engine. The solenoid valves discharge into a common chamber having a spray nozzle located at the downstream end thereof. No valve is located between the solenoid valves and the discharge end of the spray nozzle. In use, when the solenoid valves are open, the pressure drop across the solenoid valves is small with substantially the entire pressure drop associated with the assembly occurring across the nozzle. Accordingly a relatively low hold current is required by the solenoid valves.

5 Claims, 1 Drawing Sheet

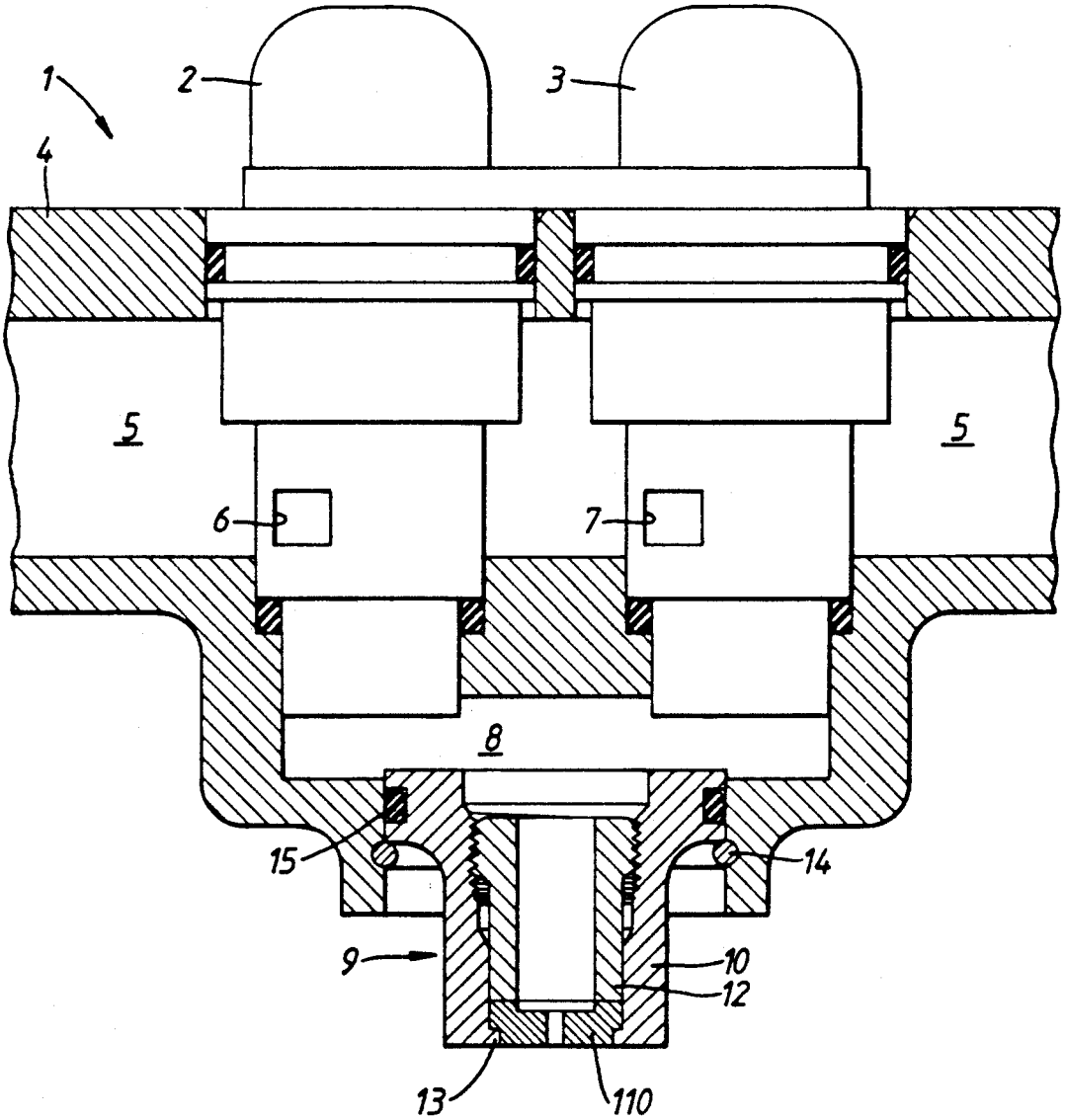
1
2
3
4
5
5
6
7
8
15
14
9
10
12
13
110

FUEL INJECTION ASSEMBLY FOR INTERNAL COMBUSTION ENGINE

This invention relates to a fuel injection assembly for an internal combustion engine, and in the preferred embodiment provides a fuel injection assembly particularly suitable for a high performance petrol engine.

Known fuel injections assemblies for petrol engines have comprised a solenoid valve having a spray nozzle at the outlet thereof to provide a spray of fuel in response to opening of solenoid valve. With such known injectors the rate at which fuel can be injected is dependent on the pressure drop across the solenoid valve. The maximum pressure differential at which a solenoid valve will reliably operated is, in practice, determined by the operating current available. As a practical matter, the rate at which fuel can be injected with a conventional arrangement is severely limited with the result that a relatively long injection period is necessary in order to supply sufficient fuel per cylinder charge. In practice, a typical indirect (port) injector will be more or less continuously injecting under full throttle driving conditions.

Whilst such injection assemblies have proved reasonably satisfactory for most engines, they do suffer from significant disadvantage. Firstly they have proved inadequate for very high performance engines such as those used, for example, in racing cars where it is necessary under full throttle conditions to provide a very large fuel flow rate. Secondly, even for conventional car engines the very long periods of injection required under full throttle conditions do not admit to precise control of the combustion conditions with the result that the engine will produce excessive pollutants.

If the size of a conventional fuel injection assembly is increased to provide the desired fuel flow rate, the moment of inertia of the moving parts of the solenoid valve becomes large, and accordingly the maximum number of operations per second of the fuel injection assembly becomes undesirably limited. Also, if the size of the injection nozzle is made large enough to accommodate the desired maximum flow rate it becomes very difficult to provide accurate control of fuel flow at the very low flow rates required under engine idle conditions. If the physical size of the injection nozzle is kept small in order to avoid the problem of excessive moment of inertia referred to above, and the fuel pressure is increased in order to increase flow rate, the valve requires a very high level of hold current in order to maintain the valve open during injection periods. This leads to difficulties in the electronic control systems necessary to control opening of the solenoid valves.

We have now found that the problems outlined above can be avoided if a plurality of solenoid valves are connected to a common chamber having at least one spray nozzle at the downstream end of thereof. By placing the spray nozzle at the downstream end of a common chamber to which the solenoid valves are connected the solenoid valves can operate under conditions where a relatively low pressure differential exists across the solenoid valve. Because the pressure differential across the solenoid valves is low, the fuel supply pressure can be increased without requiring an excessively high operating current for the solenoid valves. The high fuel pressure means that when the solenoid valves are open a large flow rate is produced, thereby permitting sufficient fuel for each induction stroke to be sprayed into the inlet manifold during a relatively short period of time. The short period required for injection can be precisely controlled as to duration and timing relative to crankshaft angle, and the precisely defined timing can readily be varied under electronic program control to suit particular engine operating conditions.

Accordingly, one aspect of the present invention provides a fuel injection assembly for an internal combustion engine comprising: at least two solenoid valves, the outlets of which are connected to a common chamber; and at least one spray nozzle forming the downstream end of said common chamber to provide a spray of fuel in response to opening of at least one of the solenoid valves.

It has been found that by appropriately designing the common chamber, no valving arrangement need be provided downstream of the solenoid valves themselves, i.e. no form of valve need be provided at the downstream end of the common chamber.

The invention will be better understood from the following description of a preferred embodiment thereof, given by way of example only, reference being had to the accompanying drawing wherein the single Figure is a view, partly in section, of a preferred embodiment of the invention.

Referring to the drawing, the fuel injection assembly 1 comprises a pair of solenoid valves 2,3 secured to a manifold 4 in which is formed a fuel supply passage 5. In use, fuel under pressure is present at all times within the passage 5, and is supplied to the solenoid valves 3,4 via inlet openings 6,7. Advantageously, the solenoid valves 2,3 are of the type commonly used in conventional electronic petrol injection systems.

The outlet end of each solenoid valve 2,3 is connected to a chamber 8 which is common to both solenoid valves. The downstream end of the chamber 8 is formed by a nozzle assembly 9 comprising a nozzle body 10, spray tip 11, and a feed tube 12. The feed tube 12 is in screw-threaded engagement with the body to clamp the tip 11 against an inturned flange 13 at the low extremity of the body.

The entire nozzle assembly 9 is secured to the manifold 4 by a circlip 14 and an O-ring 15 is provided to form a fluid seal between the nozzle assembly 9 and the manifold 4.

The interior of the feed tube 13 forms part of the chamber 8, and the spray tip 11 forms the extreme downstream end of the chamber 8. It has been found that with the arrangement illustrated, air is readily bled from the chamber 8 and there is no tendency, in use, for fuel to leak from the injection assembly when the solenoid valves are closed. Accordingly, opening of one or both solenoid valves provides substantially instantaneous spray of fuel from the spray tip.

Under idle only conditions, only one of the solenoid valves 2 need be energized in order to provide the relatively small amount of fuel required. As engine speed and load increases, the solenoid valves 2,3 are controlled by an electronic control system to meter the required amount of fuel at each opening. Under full throttle conditions, both solenoid valves open to provide the desired amount of fuel. As soon as the valves open fuel pressure builds within the chamber 8 producing a relatively small pressure differential across the valves. Thus, the fuel supply pressure in the passage 5 can be maintained at a level sufficient to produce a high rate of flow through the opening of the spray tip 11 when the valves are open. Accordingly, the required volume of fuel can be injected during a relatively short and precisely timed injection period. Further, because of the low pressure differential across the solenoid valves a relatively low current is required to hold the solenoid valves open. Accordingly, the solenoid valves can satisfactorily be operated by applying an initial high spike current to open the solenoid valves, and thereafter a relatively low hold current to maintain the solenoid valves open during the remainder of the injection period.

I claim:

1. A fuel injection assembly for an internal combustion engine comprising:

at least two solenoid valves, the outlets of which are connected to a common chamber; and at least one spray nozzle forming the downstream end of said common chamber to provide a spray of fuel in response to opening of at least one of the solenoid valves, there being no valve located between said solenoid valves and the outlet of said spray nozzle.

2. A fuel injection assembly according to claim 1 wherein the solenoid valves are connected to a common manifold which is charged with fuel under pressure at all times during operation of the internal combustion engine.

3. A fuel injection assembly according to claim 1 wherein, when the solenoid valves are open the pressure drop across the spray nozzle is substantially higher than the pressure drop across the solenoid valves.

4. A fuel injection assembly according to claim 1 including means for selectively opening the solenoid valves under program control.

5. A fuel injection assembly according to claim 4 wherein the means for selectively opening the solenoid valves is operative to open one only of the solenoid valves under engine idle conditions.

* * * * *